United States Patent [19]

Prunbauer

[11] 4,368,629

[45] * Jan. 18, 1983

[54] LOCK SYSTEM

[75] Inventor: Kurt Prunbauer, Herzogenburg, Austria

[73] Assignee: Evva Werk Spezialerzeugung von Zylinderschlössern Gesellschaft MbH & Co. Kommanditgesellschaft, Vienna, Austria

[ * ] Notice: The portion of the term of this patent subsequent to Sep. 25, 1996, has been disclaimed.

[21] Appl. No.: 52,964

[22] Filed: Jun. 26, 1979

Related U.S. Application Data

[60] Division of Ser. No. 919,559, Jun. 27, 1978, which is a continuation of Ser. No. 762,418, Jan. 25, 1977.

[30] Foreign Application Priority Data

Jan. 28, 1976 [AT] Austria ..... 592/76

[51] Int. Cl.[3] ..... E05B 19/04

[52] U.S. Cl. ..... 70/406; 70/409; 70/411

[58] Field of Search ..... 70/345–346, 70/402, 405–406, 411

[56] References Cited

U.S. PATENT DOCUMENTS 3,499,304 3/1970 Novjoks ..... 70/406

4,168,617 9/1979 Prunbauer ..... 70/406

FOREIGN PATENT DOCUMENTS 88591 2/1960 Denmark ..... 70/406

1553522 4/1970 Fed. Rep. of Germany ..... 70/405

*Primary Examiner*—Robert L. Wolfe

*Attorney, Agent, or Firm*—Michael J. Striker

[57] ABSTRACT

A lock system has a master-only lock which can be opened only by a master key and a subordinate lock which can be opened by a subordinate key and a master key. The master-key slot of the master-only lock is formed with a plurality of parallel longitudinally extending and inwardly projecting guide ridges and a plurality of parallel longitudinally extending and inwardly open variable recesses interleaved with and parallel to the guide ridges. The master key is complementarily shaped. The subordinate lock has guide ridges and variable recesses identical to that of the master-only lock, and in addition is formed with further variable recesses in which fit corresponding further ridges on the subordinate key. Thus, the subordinate key is of larger cross-sectional area than the master key so that it cannot fit into the master lock. The various guide ridges provided in all the locks and variable recesses which change from lock to lock are interleaved with each other to discourage machining of a subordinate key down into a master key.

15 Claims, 7 Drawing Figures

LOCK SYSTEM

This is a division, of application Ser. No. 919,559, filed June 27, 1978, which in turn is a continuation of application Ser. No. 762,418 filed Jan. 25, 1977.

CROSS-REFERENCE TO RELATED APPLICATION

This application is related to my copending and commonly assigned patent application 700,207 filed June 28, 1976, the entire disclosure of which is herewith incorporated by reference.

BACKGROUND OF THE INVENTION

The present invention relates to a lock system. More particularly this invention concerns such a system wherein a plurality of locks which can be operated by respective keys that cannot operate the other locks can all be also operated by a single master key.

Lock systems are known and in common use which employ a plurality of similarly constructed locks which each have a respective key for operating the respective lock and none of the other locks. In addition such a system includes a master key that can operate all of the locks. Such an arrangement is particularly advantageous in an apartment building so that each tenant can be provided with his or her own key that opens only his or her own apartment. The custodial staff nonetheless can be provided with a single master key that serves to open any of the apartment doors, thereby eliminating the necessity of carrying a great many different keys.

Typically such a system simply uses split pin tumblers in the locks so that each lock can be operated by two differently bitted keys. Such a system can be produced at relatively low cost, but has the concomitant disadvantage that a person having a subordinate key, that is a key other than the master key, can relatively easily ascertain just what the bitting is for the master key and appriately file down his or her subordinate key to produce such a master key.

It has also been suggested to profile the master and subordinate keys differently. In all such arrangements the master key has a cross-sectional area which is smaller than that of any of the subordinate keys, so that this master key can fit into the slot of a subordinate key, but the subordinate key cannot fit into the slot of a master lock designed to open only for the master key. Typically, this is accomplished by forming one or more ridges along the sides of the blade of the key. Such a ridge is normally spaced from the guide edge of the key, that is, the edge opposite the bitted edge of the blade thereof. Most generally the blade of the master key except for the region immediately adjacent its guide edge is simply flat, so that a would-be burglar or the like need merely file his or her subordinate key flat in order for it to fit into the master-only key slot.

Another disadvantage of such systems is that they adapt themselves relatively poorly to systems wherein it is desired to submaster some of the locks, that is, provide a subgroup of locks which can all be opened with a single submaster key that can nonetheless not open any of the other locks of this system. Of course, in such a submastered system there is still one overall master key which can open any lock of the system, and there is normally at least one lock which can be opened only by the master key.

SUMMARY OF THE INVENTION

It is therefore an object of the present invention to provide an improved lock system.

Yet another object is to provide such a lock system wherein conversion of a subordinate key into a master key is virtually impossible.

Yet another object is to provide a lock system that can readily be submastered.

These objects are attained according to the present invention in a lock system as generally described above, but wherein the so-called guide or master formations on all of the keys are not simply provided along one edge thereof, but are interleaved with the so-called variable formations that prevent insertion of the subordinate keys into the master-only slot of the master key or which prevents subordinate keys from one submastered group from fitting within the slots of another group.

More specifically in accordance with this invention the system comprises a master-only lock having a master-key slot formed with a plurality of parallel longitudinally extending and inwardly projecting guide formations and with a plurality of parallel longitudinally extending and inwardly projecting variable formations interleaved with these guide formations. The master key is insertable longitudinally into and is of complementary cross-sectional shape to the master-key slot, so that this master key can operate the master-only lock. The subordinate lock has a subordinate-key slot formed with a plurality of parallel longitudinally extending and inwardly projecting guide formations identical to the guide formations of the master-key slot and with inwardly open longitudinally extending recesses interleaved with the respective guide formations and situated at locations corresponding to the variable formations of the master-key slot. The master key is receivable in the subordinate-key slot with space between the master key and the recesses. The subordinate key is insertable longitudinally into and is of complementary cross-sectional shape to the subordinate-key slot. This subordinate key is of greater cross-sectional area at the formations than the master key and is too large in cross-sectional size to fit into the master-key slot. The subordinate lock is operable by the subordinate key and by the master key.

More particularly, in accordance with the present invention the formations of the master-key slot are constituted as a plurality of parallel longitudinally extending and inwardly projecting guide ridges and of a plurality of parallel longitudinally extending and inwardly open variable recesses interleaved with and parallel to the guide ridges. The master key is formed with a plurality of parallel longitudinally extending and outwardly open guide grooves and with a plurality of parallel longitudinally extending and outwardly projecting variable ridges matable with the guide ridges and with the variable recesses respectively on fitting of the master key into the master-key slot. The subordinate lock on the other hand is formed at its slot with a plurality of inwardly projecting guide ridges and inwardly open variable recesses identical to the corresponding ridges and recesses of the master-key slot. In addition this subordinate-key slot is formed in at least one of its variable recesses with at least one inwardly open and longitudinally extending variable groove. The master key is receivable in the subordinate-key slot with a space between itself and the further variable groove. Finally, the subordinate key is formed in the same manner as the master key, but with an extra outwardly projecting variable ridge that can fit within the variable groove of the subordinate-key slot, but which prevents entry of the subordinate key into the master-key slot.

With the system according to the present invention the interleaving of the various guide and variable formations insures that machining of a subordinate key so as to fit it within a master-key slot is an extremely onerous job that greatly increases the security offered by a lock. Indeed the deterrent effect is so great as to altogether rule out rebuilding of a subordinate key for use in a master-key slot.

According to further features of this invention the ridges and grooves are of rectangular cross-sectional shape and the further outwardly projecting variable ridge on the subordinate key extends laterally beyond any of the other variable ridges matable with the respective guide recesses. Thus, the subordinate key is thicker at its further ridge than the master key is at any location.

It is also possible according to this invention to form the master key of zig-zag shape, that is with its opposite sides each formed of a plurality of planar facets each of which is substantially parallel to a respective planar facet on the other side of the key. With such a key having a blade effectively formed of a stack of rhombuses seen in end view the difficulty of machining-down the subordinate key so as to fit it into the master-key slot is so great that such an operation is almost entirely ruled out.

Of course, with all of the keys according to the present invention it is possible to bit them and provide them with magnets much as described in my above-cited copending application. The result is a virtually pick-proof lock cylinder.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

SPECIFIC DESCRIPTION OF PREFERRED EMBODIMENTS

Figure 1:
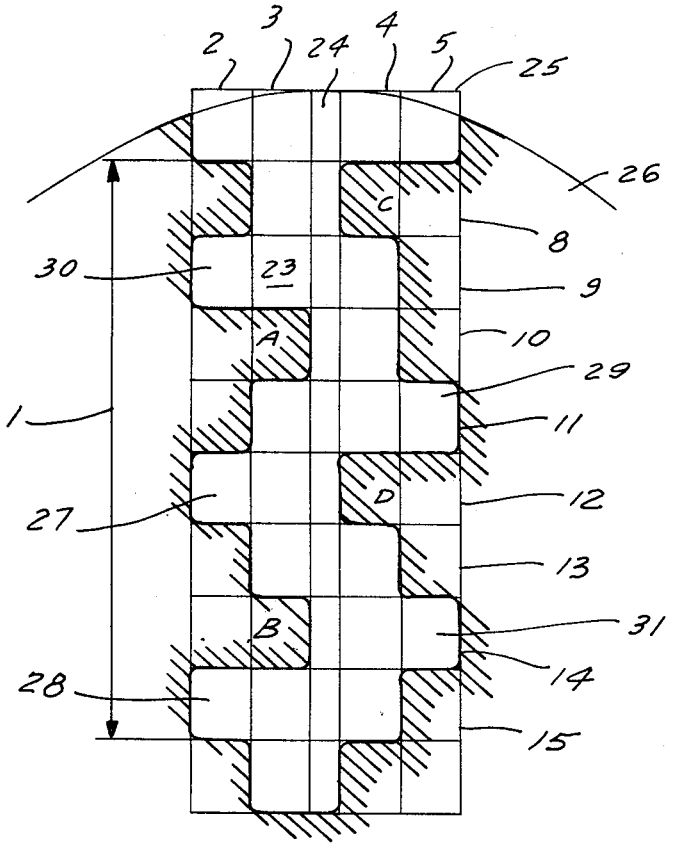
FIGS. 1, 2, and 3 are cross-sectional and largely diagrammatic views through three different locks and keys according to a first embodiment of the present invention.
Figure 2:
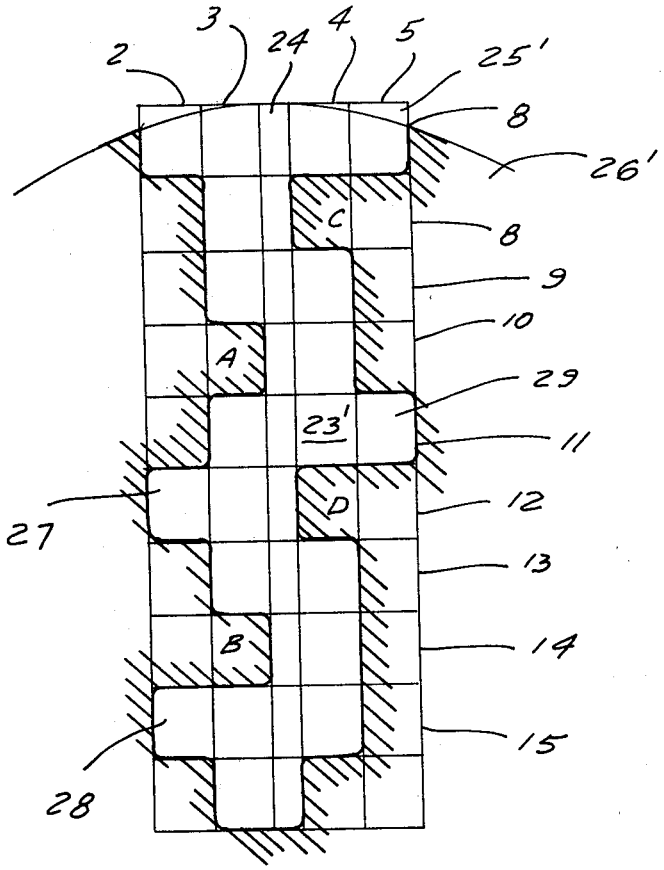
Figure 3:
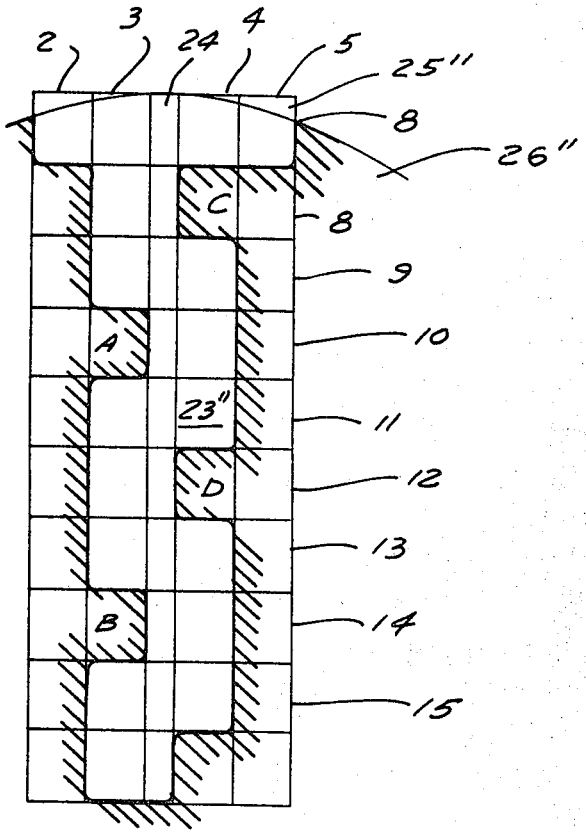

As shown in FIGS. 1–3 a lock system according to this invention can comprise a secondary key 25 and cylinder barrel 26 (FIG. 1), a primary key 25' and cylinder barrel 26' (FIG. 2), and a master key 25'' and cylinder barrel 26'' (FIG. 3) formed with respective key slots 23, 23', and 23''.

The key blades, which are not here hatched in order to maximize clarity of view, are at their bases of rectangular shape and are subdivided transversely into four sections 2–5, with sections 3 and 4 flanking a central strip 24 which is here shown of substantially exaggerated width for clarity of view. In addition, each key blade is sub-divided along each of its sides into eight rows 8–15 defining an overall height 1 within which each of the keys is formed with guide and variable formations as will be described below.

With reference first to FIG. 3 it can be seen that the entire useful area of the key is confined within the regions 3 and 4 flanking the region 24 which may in reality be of zero width. The slot 23' is formed with four inwardly projecting guide formations or ridges A-D of rectangular shape. The ridges A and B are provided in section 3 at rows 11 and 15 and the ridges C and D are provided in the section 4 at the rows 9 and 13. Thus, the formations A-D are equispaced down the slot 23'' on opposite sides thereof. The master key 25'' is of exactly complementary shape. It should be obvious by a comparison of FIGS. 1 and 2 with FIG. 3 that key 25'' can fit into either of the slots 23 or 23'. Assuming that the keys 25, 25', and 25'' are all bitted the same, or are appropriately mastered, it is therefore possible for key 25'' to fit into either of cylinder barrels 25 and 26' as well as into cylinder barrel 26'' so as to operate any of the locks.

The slot 23' of FIG. 2 is formed with inwardly projecting ridges A-D identical to those of the slot 23''. In addition the slot 23' is formed in the sector 2 at the rows 13 and 16, respectively, with inwardly open square-section grooves 27 and 28 and in the sector 5 at the row 12 with an inwardly open square-section groove 29. The key 25' is complementarily shaped with outwardly projecting ridges. Thus, the key 25' can fit snugly into the slot 23', but cannot fit into the slot 23'' as the formations 27–29 prevent such insertion.

The slot 23 of FIG. 1 is similarly provided with the formations 27–29 so that the key 25' can indeed fit into the cylinder barrel 26 of FIG. 1 so as to operate the respective lock. In addition the slot 23 of FIG. 1 is formed in the section 2 at row 9 with an inwardly open square-section groove 30 and on the opposite side in the section 5 at the row 14 with an inwardly open square-section groove 31. The key 25 is complementarily shaped so that this key 25 can only fit into the slot 23.

Thus, the master key 25'' of FIG. 3 can open the locks of FIGS. 1 and 2 as well as the lock of FIG. 3. The key 25' of FIG. 2 can only operate the locks of FIGS. 1 and 2, and the key 25 of FIG. 1 can only operate the lock of FIG. 1. It is therefore possible with the system of the present invention to master and submaster a lock system. It is noted that the particular placement of the various formations can be varied within wide limits while still remaining within the scope of this invention.

Figure 4:
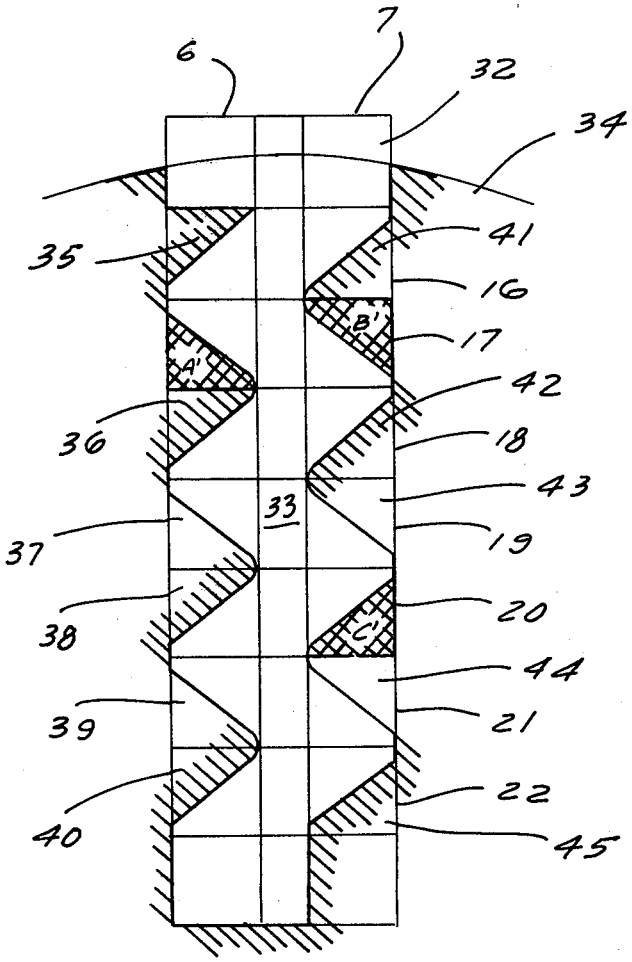
FIGS. 4–7 are similar views through locks and keys of a second embodiment of this invention.
Figure 5:
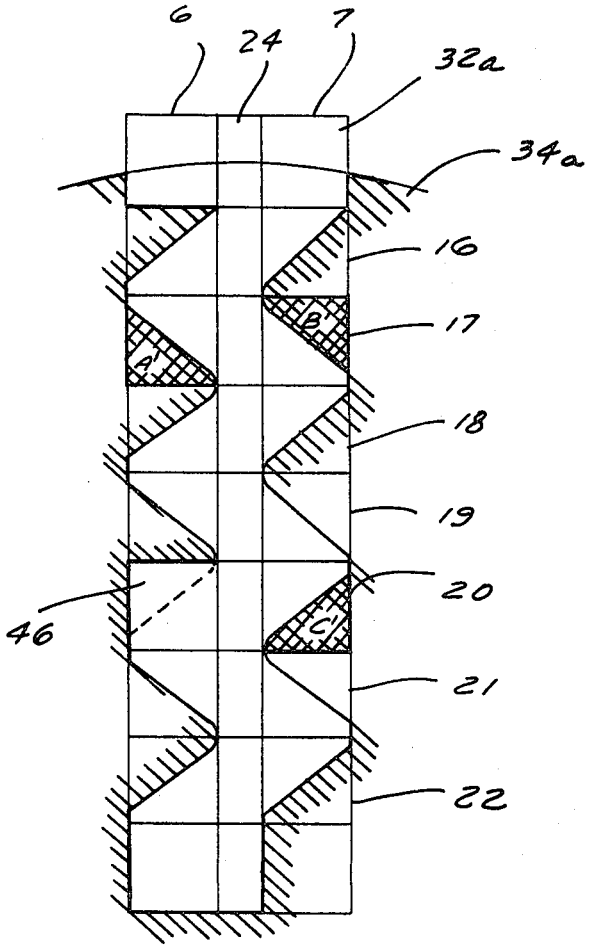
Figure 6:
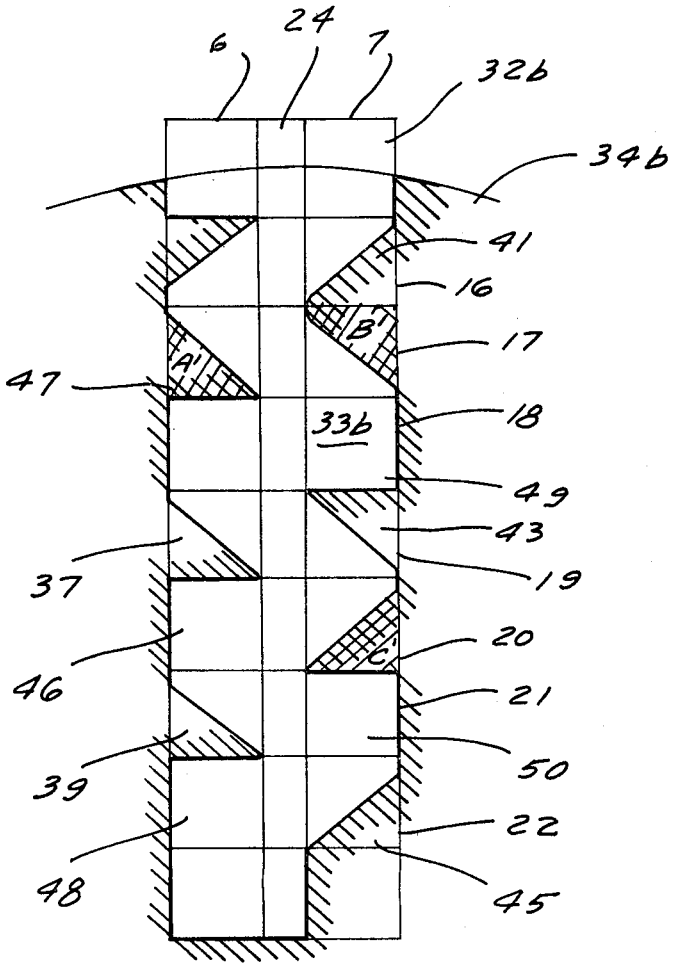
Figure 7:
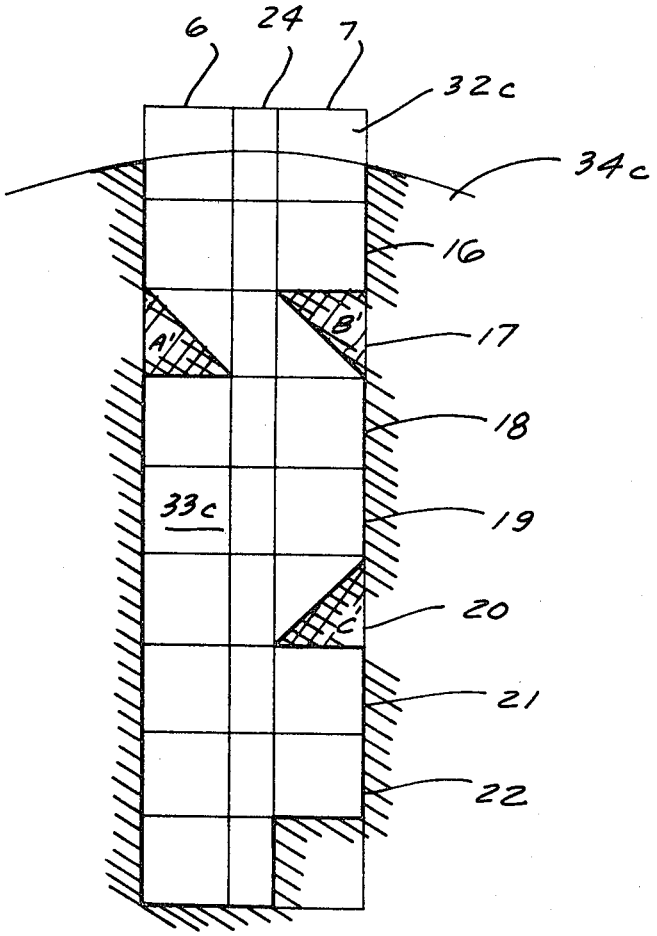

The arrangement shown in FIGS. 4–7 is identical in principle to that shown in FIGS. 1–3, but here the master key 32 shown in FIG. 4 and the corresponding slot 33 therefor are both formed of substantially more facets than any of the subordinate keys **32*a*-32*c* and the corresponding subordinate-key slots 33*a*-33*c* of the corresponding cylinder barrels 34*a*-34*c*. FIG. 4 shows the master key 32 and the corresponding cylinder barrel 34 whereas FIG. 7 shows the least complex subordinate key 32*c***, that is the key of the simplest or least faceted shape.

The master key 32 of FIG. 4 is subdivided into two sections 6 and 7 again flanking a central region 24, with the key divided longitudinally into seven rows or stripes 16–22 corresponding to the regions 8–15 on the keys of FIGS. 1–3. It is noted that in this arrangement the section 24 down the center is again shown to be of substantially larger dimensions than it really is, it indeed being desirable that this section 24 in reality be eliminated, so that an attempt to file down a key according to this invention will so greatly weaken the key being so machined that such a key will be unusable.

FIG. 4 therefore shows a master key 32 of generally zig-zag shape, with its faceted sides extending at angles of 45° to a plane down the center of the key 32. Comparison of FIGS. 4 and 7 shows that only three guide regions A'-C' are employed. One of the guide regions A' is of right-triangular shape and is located on the one side 6 at the row 17. The other two guide formations B' and C' are located on the other side 7 at the regions 17 and 20. FIG. 7 shows how a subordinate key 32*c* merely has three right-triangular section grooves corresponding to the formations A'-C'. It should be plain that the master key of FIG. 4 will fit easily into the slot 33*c* of FIG. 7, as will either of the other subordinate keys 32*a* and 32*b*. The master key slot 33 of FIG. 4 is also formed on the side 6 with inwardly projecting right-triangular ridges 35, 36, 37, 38, 39, and 40 respectively lying in the regions 16, 18, 19, 20, 21, and 22. The ridges 37 and 38 together form an isosceles triangle as do the regions 39 and 40. On the other side 7 the key is formed with five further variable formations 41–45, respectively situated in the rows 16, 18, 19, 21, and 22. The two ridges 42 and 43 together form an isosceles triangular formation. It is noted that the ridges 36, 41, and 44 combined with the guide formations A', B', and C', respectively, also form ridges of isosceles-triangular shape.

The subordinate key 32*a* and the corresponding subordinate-key slot 33*a* shown in FIG. 5 are identical to the arrangement of FIG. 4, except that here the formation 38 has been eliminated from the slot 33*a* and the key 32*a* has been provided with a corresponding right-triangular ridge 46, so that the key 32*a* fits exactly and snugly into the slot 33*a*. The master key 32 of FIG. 4 will also fit into the slot 33*a* of FIG. 5 and operate the barrel 34*a* of the corresponding lock.

The subordinate key 32*b* and the slot 33*b* of FIG. 6 are identical to those shown in the arrangement of FIG. 5, except that here formations 36, 40, 42, and 44 have been eliminated in addition to the formation 38, and corresponding right-triangular ridges 47, 48, 49, and 50 have been provided on the key 32*b*. Thus, the key 32*a* as well as the key 32 can both be inserted in the slot 33*b* to operate the lock having the corresponding barrel 34*b*.

Finally, the key slot 33*c* and key 32*c* of FIG. 7 carry only the guide formations A'-C'. The key 32*c* is only formed with three right-triangular section recesses or grooves corresponding to these ridges A'-C'. Any of the keys 32, 32*a* or 32*b* can be inserted into and operate the lock of FIG. 7, whereas the key 32*c* of FIG. 7 can only fit into the slot 33*c*.

It is noted that the arrangement shown in FIGS. 4–7 can be combined with the arrangement shown in FIGS. 1–3 in any desirable manner. Thus, for example, it would be possible to form a key in one side as shown in FIGS. 1–3 or on the other side as shown in FIGS. 4–7. Any other combination of the two would similarly be possible.

With the system according to the present invention the possibility of machining down a subordinate key in order to turn it into a master key is almost entirely ruled out, as the work necessary to transform the shape of the key would be extremely laborious. Furthermore, it is possible with the system according to this invention to submaster a lock system, so that a single master key can open any lock of the system and each of a plurality of submaster keys can open any of a plurality of subgroups, and each secondarily subordinate key can further open only its own lock. Within subgroups it is also possible to submaster as shown in FIGS. 4–7 wherein the key of FIG. 4 can open every lock, the key of FIG. 5 can open three of them, the key of FIG. 6 can open two, and the key of FIG. 7 only one.

It will be understood that each of the elements described above, or two or more together, may also find a useful application in other types of structure differing from the types described above.

While the invention has been illustrated and described as embodied in a lock system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A lock system comprising:

a master-only lock having a master-key slot formed with a plurality of parallel longitudinally extending and inwardly projecting guide ridges and with a plurality of parallel longitudinally extending and inwardly open variable recesses arranged between said guide ridges;

a master key insertable longitudinally into said master-key slot and formed with a plurality of parallel longitudinally extending and outwardly open guide grooves and with a plurality of parallel longitudinally extending and outwardly projecting variable ridges matable with said guide ridges and with said variable recesses respectively on fitting of said master key to said master-key slot, said master only lock being operable by rotation of said master key after insertion thereof into said master-key slot;

a primary subordinate lock having a primary subordinate-key slot formed with a plurality of parallel longitudinally extending and inwardly projecting guide ridges identical to said guide ridges of said master-key slot, with a plurality of parallel longitudinally extending and inwardly open variable recesses identical to said variable recesses of said master-key slot, and in said variable recesses with at least one further inwardly open and longitudinally extending variable groove, said master key being receivable in said primary subordinate-key slot with a space between said master key and said further variable groove;

a primary subordinate key insertable longitudinally into said primary subordinate-key slot and formed with a plurality of parallel longitudinally extending and outwardly open guide grooves, with a plurality of parallel longitudinally extending and outwardly projecting variable ridges, and with a further outwardly projecting variable ridge matable with said guide ridges, with said variable recesses, and with said further variable recess respectively for snug fitting of said primary subordinate key in said primary subordinate-key slot, said primary subordinate key being of greater cross-sectional area than said master key and being too large in cross-sectional size to fit into said master key slot, said primary subordinate lock being operable by said primary subordinate key and by said master key;

a secondary subordinate lock having a secondary subordinate-key slot formed with a plurality of parallel longitudinally extending and inwardly projecting guide ridges identical to said guide ridges of said master-key slot, with a plurality of parallel longitudinally extending and inwardly open variable recesses identical to said variable recesses of said master-key slot, and in said variable recesses with at least one further inwardly open and longitudinally extending variable groove, said master key and said primary subordinate key being receivable in said secondary subordinate-key slot with a space between said master key and said further variable groove; and a secondary subordinate key insertable longitudinally into said secondary subordinate-key slot and formed with a plurality of parallel longitudinally extending and outwardly open guide grooves, with a plurality of parallel longitudinally extending and outwardly projecting variable ridges, and with a further outwardly projecting variable ridge matable with said guide ridges, with said variable recesses, and with said further variable recess respectively for snug fitting of said secondary subordinate key in said secondary subordinate-key slot, said secondary subordinate key being of greater cross-sectional area than said primary subordinate key and being too large in cross-sectional size to fit into said primary subordinate key slot, said secondary subordinate lock being operable by said secondary subordinate key said primary subordinate key and by said master key.

2. The system defined in claim 1 wherein said ridges and grooves are of rectangular cross-sectional shape.

3. The system defined in claim 1 wherein said further outwardly projecting variable ridge extends laterally beyond the respective variable ridge matable with the respective guide recess, said subordinate key being thicker at said further ridge than said master key.

4. The system defined in claim 3 wherein said ridges and grooves are of rectangular cross-sectional shape.

5. The system defined in claim 1 wherein said ridges and grooves are of triangular cross-sectional shape.

6. The system defined in claim 1 wherein said master key is of generally zig-zag shape and has opposite sides formed of planar facets each substantially parallel to a respective planar facet of the other side.

7. The lock system defined in claim 1 wherein each of said keys has a blade insertable into the respective slot and having a pair of sides formed with longitudinally extending recesses matable with the respective guide ridges, each blade further having a back edge and opposite said back edge a bitted edge.

8. The lock system defined in claim 7 wherein said guide ridges and recesses are of rectangular cross-sectional shape.

9. The lock system defined in claim 7 wherein said keys are each formed along their said sides with longitudinally extending ridges and recesses shaped complementary to the respective formations of the respective slots.

10. The lock system defined in claim 1 wherein said ridges on said primary and secondary subordinate keys that mate with said recesses of said primary and secondary subordinate-key slots project laterally substantially beyond any other portion of said subordinate key.

11. The lock system defined in claim 1 wherein said ridges and grooves of said primary and secondary subordinate key that mate with said variable formations are more numerous than said ridges and grooves of said primary and secondary subordinate key that mate with said guide formations.

12. The lock system defined in claim 7 wherein said ridges of said primary and secondary subordinate key on each side of the respective blade all have coplanar crests.

13. The lock system defined in claim 1 wherein said primary and secondary subordinate key has more of said ridges than said master key.

14. The lock system defined in claim 1 wherein said master key has more of said ridges than said primary and secondary subordinate key.

15. The lock system defined in claim 1 wherein said guide ridges are generally triangular and said master key only is generally zig-zag shaped with generally parallel opposite side facets.

* * * * *